US005992002A

United States Patent [19]

Hung

[11] Patent Number: 5,992,002

[45] **Date of Patent: *Nov. 30, 1999**

[54] APPARATUS FOR THE CUTTING, STRIPPING AND CRIMPING OF A PLUG ONTO A TELCO CORD

[76] Inventor: Ying-Teh Hung, No. 9 Ta-Tung St., Industrial District Tu-cheng Hsiang, Taipei Hsien, Taiwan

[ * ] Notice: This patent is subject to a terminal disclaimer.

[21] Appl. No.: 09/005,392

[22] Filed: Jan. 9, 1998

[51] Int. Cl.[6] ..... H01R 43/04

[52] U.S. Cl. ..... 29/566.4; 7/107; 29/33 M; 29/751

[58] Field of Search ..... 29/566, 566.1, 29/566.3, 566.4, 33 M, 747, 748, 750, 751, 753, 758; 7/107

[56] References Cited

U.S. PATENT DOCUMENTS

| | | | |
|---|---|---|---|
| 4,429,451 | 2/1984 | Angelico | 29/566.4 |
| 4,480,374 | 11/1984 | Meyer | 29/566.4 |
| 4,557,034 | 12/1985 | Pfundt | 29/566.4 |
| 4,571,764 | 2/1986 | Chen et al. | 7/107 |
| 4,625,386 | 12/1986 | Bieganski | 29/566.4 |
| 4,713,874 | 12/1987 | Schwartz | 29/566.4 |
| 4,862,580 | 9/1989 | Wang et al. | 29/566.4 |
| 4,981,032 | 1/1991 | Chen | 72/410 |
| 5,109,591 | 5/1992 | Hung | 29/566.4 |
| 5,214,842 | 6/1993 | Chen | 29/566.4 |
| 5,402,561 | 4/1995 | Cerquone et al. | 29/751 |

*Primary Examiner*—Daniel W. Howell
*Attorney, Agent, or Firm*—Harrison & Egbert

[57] ABSTRACT

An apparatus for the cutting, stripping and crimping of a onto a telco cord including a fixed handle having an internal cavity, a movable handle pivotally connected to the fixed handle, and a sliding body pivotally connected to the movable handle and resiliently connected to the fixed handle. The fixed handle has a first receptacle for receiving a common plug and a second receptacle for receiving a plug with an offset latch. The second receptacle has a main opening and a latch opening communicating with the main opening and offset from a center of the main opening. The sliding body has a first crimping block and a second crimping block thereon. The sliding body is slidable within the internal cavity between a non-crimping position and a crimping position relative to a pivotal movement between the fixed handle and the movable handle.

1 Claim, 3 Drawing Sheets

APPARATUS FOR THE CUTTING, STRIPPING AND CRIMPING OF A PLUG ONTO A TELCO CORD

TECHNICAL FIELD

The present invention relates to devices for cutting telco cords. More particularly, the present invention relates to devices for stripping telco cords so as to expose the lines therein. Furthermore, the present invention relates to devices for the crimping of plugs onto telco cords.

BACKGROUND ART

Most telephone technicians have to cut and peel telco cord in order to make it fit so as to be pressed onto a telco plug. Previously, various types of pliers have been proposed and implemented for the peeling and press-fitting of plugs onto telco cord. Some tools can peel telco cord but cannot press-fit the plug onto the cord. Other types of tools can press-fit only one cord onto a plug at a time after the cord has been peeled by other pliers, mainly, because it cannot peel the cord.

U.S. Pat. No. 5,109,591, issued on May 5, 1992, to the present inventor describes a pliers for the cutting and peeling of telco cord and for the press-fitting of such cord onto a telco plug. The device of this patent includes a movable handle and a fixed handle. Holes are formed within the fixed handle so as to allow for the plug to be inserted into the hole and for the line to be inserted into the plug for the purpose of crimping. A slidable body is fitted within an internal cavity of the fixed handle so that the sliding body can move upwardly and downwardly relative to a rotatable movement of the movable handle with respect to the fixed handle. A spring serves to connect the sliding body to the fixed handle.

Importantly, in this device, openings are only provided for certain types of plugs. The device is not adapted for receiving those plugs with offset latches. Furthermore, the device includes a cutting mechanism which includes a pair of cutting blades in offset relationship. Experience with the use of such blades have shown that the blades tend to eventually separate so as to cause uneven and jagged cutting of the telco cord. Also, in order to crimp the plug onto the cord, the sliding body includes a pair of crimping blocks. After extended use, it has been found that these crimping blocks tend to move from their original position because of the forces imparted to them. The sliding body was not particularly adapted so as to retain such crimping blocks in a desired position.

It is an object of the present invention to provide an apparatus for crimping of plugs onto telco cords which includes a means for crimping plugs with offset latches.

It is another object of the present invention to provide an apparatus for the cutting of telco cord which avoids the use of offset blades.

It is a further object of the present invention to provide a device for the crimping of telco plugs which facilitates the ability to repeatedly use the crimping blocks on the sliding body of the device.

It is still another object of the present invention to provide a device for the crimping, cutting and stripping of telco cords which is easy to use, relatively inexpensive, and easy to manufacture.

These and other objects and advantages of the present invention will become apparent from a reading of the attached specification and appended claims.

SUMMARY OF THE INVENTION

The present invention is an apparatus for the cutting, stripping and crimping of a plug onto a telco cord comprising a fixed handle having an internal cavity, a movable handle pivotally connected to the fixed handle, and a sliding body pivotally connected to the movable handle and resiliently connected to the fixed handle. The fixed handle has a first receptacle for receiving a common plug and a second receptacle for receiving a plug with an offset latch. The second receptacle has a main opening and a latch opening communicating with the main opening and offset from a center of the width of the main opening. The sliding body has a first crimping block and a second crimping block thereon. The sliding body is slidable in the internal cavity between a non-crimping position and a crimping position relative to pivotal movement between the fixed handle and the movable handle.

The second receptacle is positioned to a side of the first receptacle such that the latch opening is adjacent the first receptacle. The second receptacle has a width suitable for receiving a 6-pin plug. The first receptacle has a width suitable for receiving a 10-pin plug therein. The first receptacle has a latch opening positioned centrally along the width.

The fixed handle has a stripping opening formed therein. The sliding body has a stripping blade affixed thereto. The fixed handle has a stripping blade affixed thereto. The stripping blade of the sliding body is movable toward the stripping block of the fixed handle relative to an angular movement between the fixed handle and the movable handle. The stripping opening has a first receiving area and a second receiving area. The first receiving area serves to receive a 6-line telco cord. The second receiving area serves to receive a 10-line telco cord.

The fixed handle has a cutting blade affixed thereto along a surface of the fixed handle facing the movable handle. The movable handle has a flat surface formed thereon such that the flat surface contacts an edge of the cutting blade when the movable handle pivots toward the fixed handle. The flat surface is transverse to the plane of the cutting blade.

The first crimping block includes an inner cutting block affixed to a top of the sliding body on one side of the sliding body, and an outer crimping block affixed to a top of the sliding body on an opposite side of the sliding body. The sliding body has a first shoulder formed thereon abutting a bottom of the inner crimping block. The sliding body has a second shoulder formed thereon abutting a bottom of the outer crimping block. A spring has one end connected to the sliding body and an opposite end connected to the fixed handle. The spring has a resilience such that the stripping blades cut through a sheathing of the telco cord without cutting through an electrical line in the telco cord.

DETAILED DESCRIPTION OF THE INVENTION

Figure 1:
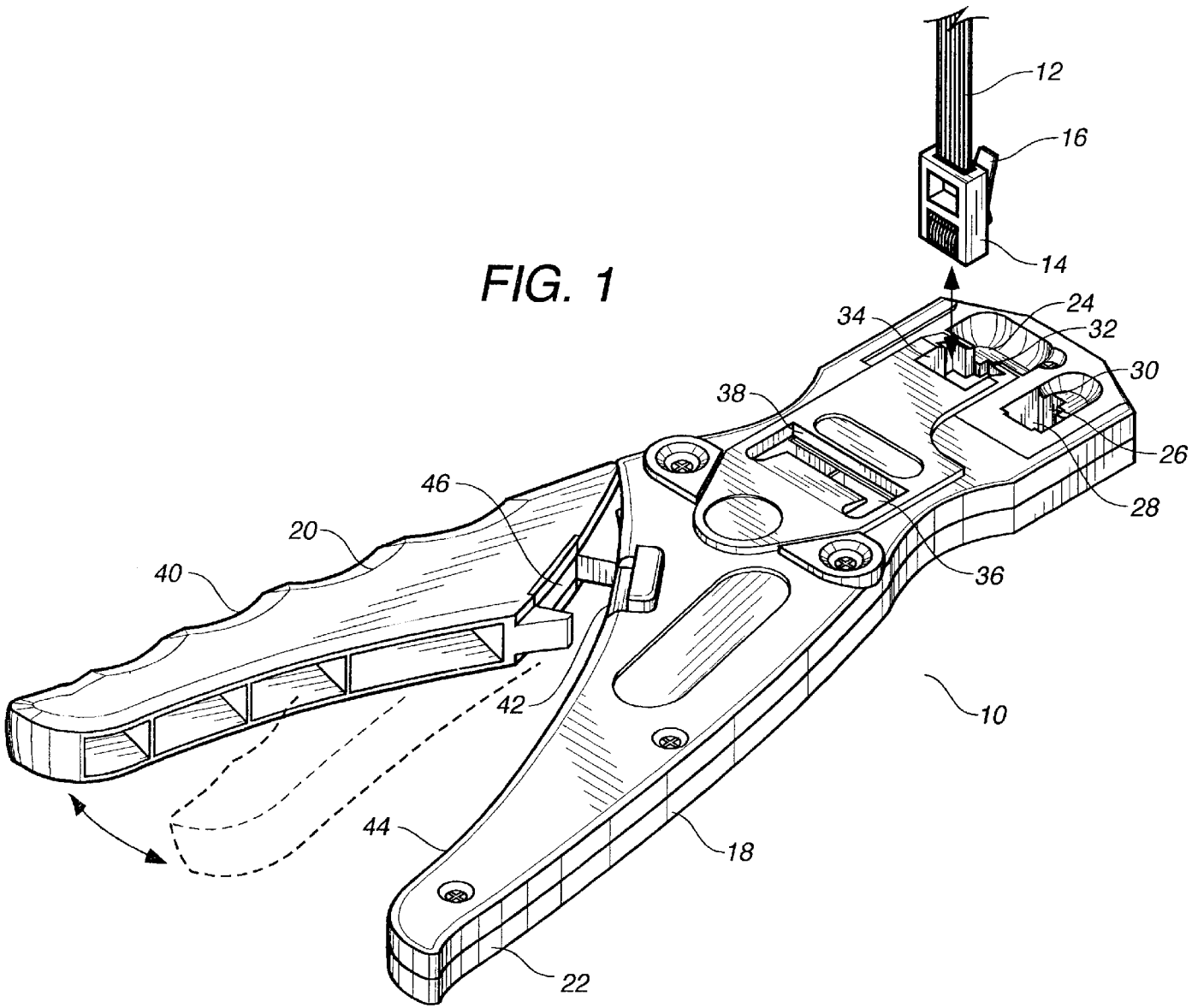
FIG. 1 is a side perspective view showing the operation of the apparatus of the present invention.

Referring to FIG. 1, there is shown at 10 the apparatus of the present invention for the cutting, stripping and crimping of a plug onto a telco cord. Also shown in FIG. 1 is the telco cord 12 having the plug 14 attached thereto. A latch 16 is formed on the plug 14 so as to facilitate the ability of the telco cord 12 to be connected to a suitable connector. The apparatus 10 of the present invention is designed so that the plug 14 can be suitably crimped onto the exposed lines on the end of the telco cord.

The apparatus 10 of the present invention includes a fixed handle 18 with an internal cavity (not shown), a movable handle 20 pivotally connected to the fixed handle 18, and a sliding body pivotally connected to the movable shoulder 20 and resiliently connected to the fixed handle 18. As can be seen in FIG. 1, the fixed handle 18 has a handle portion 22 suitable for gripping by a human hand. A first receptacle 24 is formed in the fixed handle 18 for the receipt of a common plug. A second receptacle 26 is also formed in the fixed handle 18 for the receipt of a plug 14 with an offset latch. The second receptacle 26 has a main opening 28 and a latch opening 30 formed therein. The latch opening 30 communicates with the main opening 28 and is offset from a center of the width of the main opening. In normal use, the plug 14 with the offset latch can be inserted into the opening 26 such that the latch resides within the latch opening 30 and the plug resides within the plug opening 28.

The first receptacle 24 is positioned so as to slidably receiving the plug 14 therein. The first receptacle 24 includes a suitable latch opening 32 which allows the latch 16 to slidably enter therein. The latch opening 32 is positioned along a center of the width of the main opening 34 of the first receptacle 24. In the preferred form of the present invention, the first receptacle 24 has a width suitable for receiving a 10-pin plug. The second receptacle 26 has a width for receiving a 6-pin plug with an offset latch. By this configuration of the present invention, the apparatus 10 is particularly adapted for crimping the plugs onto the exposed lines of a telco cord 12 on both 6-pin plugs with offset latches and 10-pin plugs. Neither of these features is shown nor described in U.S. Pat. No. 5,109,591 to the present inventor.

Fixed handle 18 has a stripping opening 36 formed therein. As can be seen in FIG. 1, a stripping blade 38 is affixed to the fixed handle 18. As will be described hereinafter, the sliding body will also have a stripping blade. The stripping blade of the sliding body is movable toward the stripping blade 38 of the fixed handle 18 relative to an angular movement of the movable handle 20 with respect to the fixed handle 18.

In FIG. 1, it can be seen that the movable handle 20 includes a gripping surface 40 formed thereon. The gripping surface 40 is suitable for receiving the fingers of a human hand. Importantly, the fixed handle 18 has a cutting blade 42 affixed thereto along an inner surface 44 of the fixed handle 18. The movable handle has a flat surface 46 formed thereon. The flat surface has been formed such that it contacts the cutting edge of the cutting blade 42 when the movable handle 20 moves toward the fixed handle 18. The flat surface 46 is transverse to the plane of the cutting blade 42.

In normal practice, it has been found that the present invention is an improvement over the prior art. In particular, by having the edge of the cutting blade 42 contacting the flat surface 46, the telco cord 12 is easily cut without forming jagged edges. Over extended use of the apparatus 10, it has been found that the apparatus 10 continues to evenly and smoothly cut the telco cord 12, unlike that which occurs when offset blades are used for the cutting action.

Figure 2:
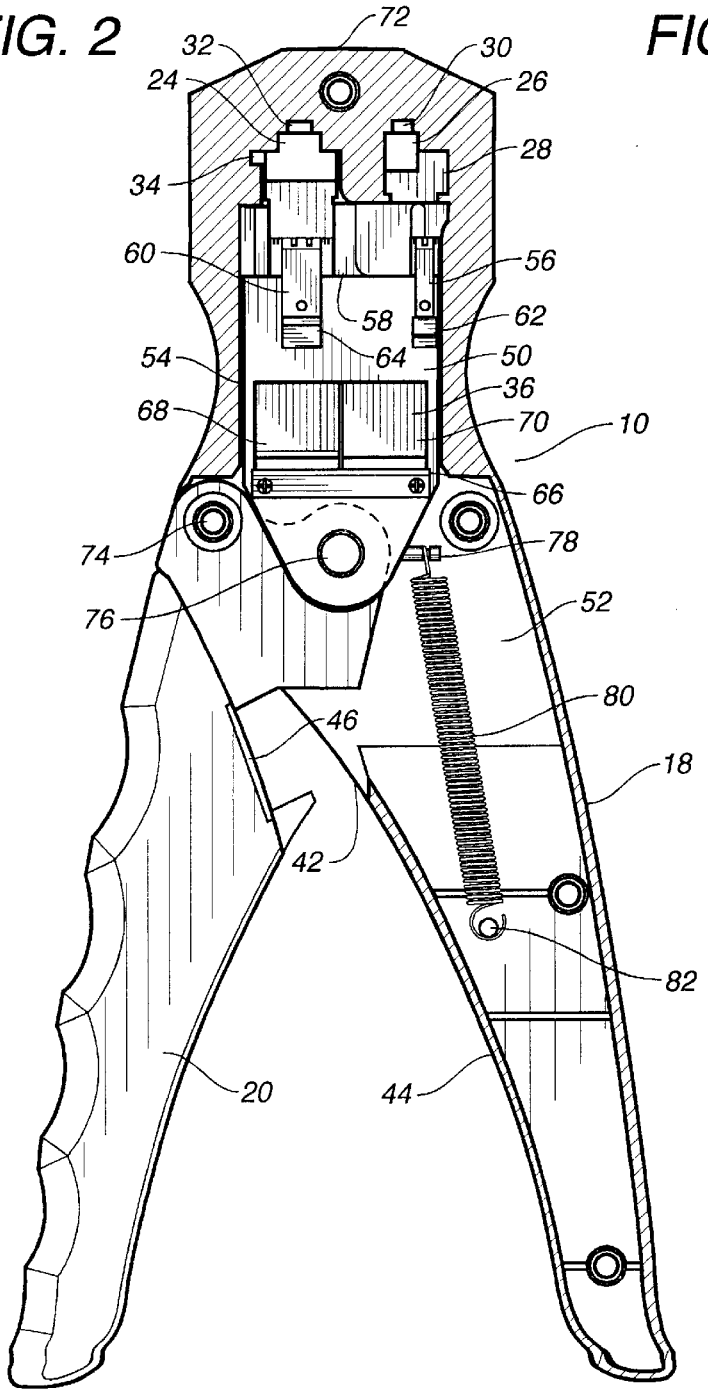
FIG. 2 is a cross-sectional side view of the apparatus of the present invention.

FIG. 2 shows the internal configuration of the apparatus 10 of the present invention. Importantly, FIG. 2 shows the action of the sliding body 50 as positioned within the internal cavity 52 of the fixed handle 18. The sliding body 50 will slide upwardly and downwardly within a channel 54 formed in the internal cavity 52. It can be seen that the sliding body 50 includes a first crimping block 56 affixed to the top edge 58 of the sliding body 50. A second crimping block 60 is also attached in spaced relationship to the first crimping block 56, along the top edge 58 of the sliding body 50. The crimping blocks 56 and 60 will move upwardly and downwardly relative to the pivotal movement of the movable handle 20 with respect to the fixed handle 18. Importantly, it can be seen that a shoulder 62 is formed on the sliding body 50 so as to abut a bottom edge of the first crimping block 56. Similarly, a shoulder 64 is formed in the sliding body 50 so as to abut a bottom edge of the second crimping body 60. The shoulders 62 and 64 have been formed so as to resist downward movement of the crimping blocks 56 and 60 during continuous use of the apparatus 10 of the present invention. The shoulders 62 and 64 add support to the crimping action expected out of the crimping blocks 56 and 60 during the crimping of the plug 14 onto the telco cord 12.

This sliding body 50 includes a stripping blade 66 affixed thereto. The stripping blade 66 is positioned at the bottom of the stripping opening 36 formed in the fixed handle 18. The stripping opening 36 is divided into a first receiving area 68 and a second receiving area 70. The first receiving area 68 is suitable for the receipt of 6-line telco cord. The second receiving area 70 is suitable for the receipt of 10-line telco cord.

In FIG. 2, it can be seen that the first receptacle 24 and the second receptacle 26 are formed near the top 72 of the fixed handle 18. The first receptacle 24 has a latch opening 32 formed generally centrally of the width of the main opening 34 for the receipt of 10-line telco cord. The second receptacle 26 has the offset latch opening 30 formed to one side of the central opening 28. Specifically, it can be seen that the bottom edges of the receptacles 24 and 26 are generally aligned. The latch opening 26 is positioned to a side of the main opening 28 adjacent to the first receptacle 24.

In FIG. 2, it can be seen that the movable handle 20 is pivotally connected at pivot point 74 to the fixed handle 18. The sliding block is pivotally connected at 76 to the movable handle 20 and to the fixed handle 18. A post 78 extends outwardly of the sliding body 50. Spring 80 has one end connected to the post 78 and another end connected to post 82 on the fixed handle 18. The spring 80 has a resiliency suitable for causing the stripping blades 38 and 68 to cut through the sheathing of the telco cord without cutting through the electrical lines within the telco cord.

In FIG. 2, it can further be seen that the cutting blade 42 is positioned along the inner surface 44 of fixed handle 18. The flat cutting surface 46 faces the cutting blade 42.

Figure 3:
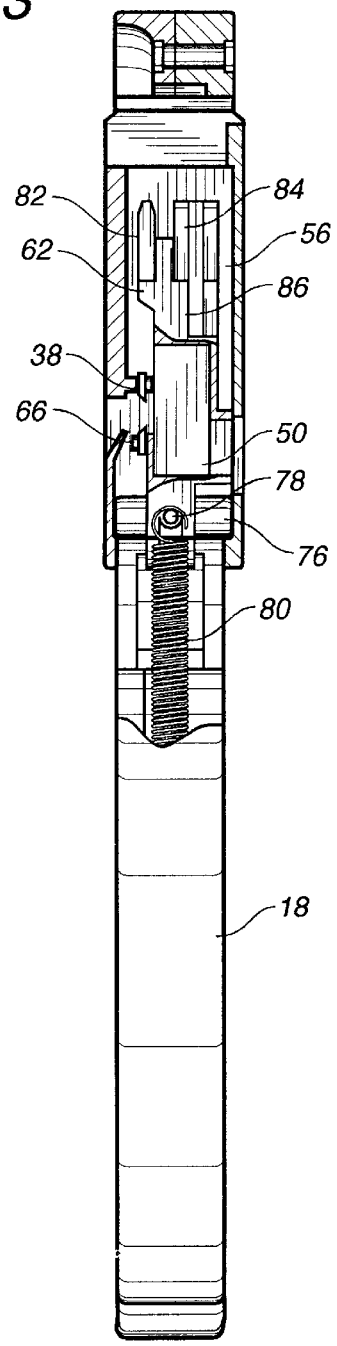
FIG. 3 is a partially cross-sectional end view of the apparatus of the present invention.

FIG. 3 shows a side view of the present invention. In particular, it can be seen that the fixed handle 18 extends upwardly. Spring 80 is connected to post 78 on the sliding body 50. Importantly, it can be seen that the first crimping block 56 includes an inner crimping block 82 affixed to one side of the sliding body 50. The first crimping block 56 also includes an outer crimping block 84 affixed to an opposite side of the sliding body 50. A shoulder 62 supports the inner crimping blocks 82. Similarly, a shoulder 86 supports the outer crimping block 84.

In FIG. 3, it can be seen that the pivot member 76 will extend through the interior of the sliding body 50 and will engage the sides of the fixed handle 18.

In FIG. 3, it can be seen that the stripping blade 38 is affixed to the fixed handle 18. The other stripping blade 66 is connected to the sliding body 50.

Figure 4:
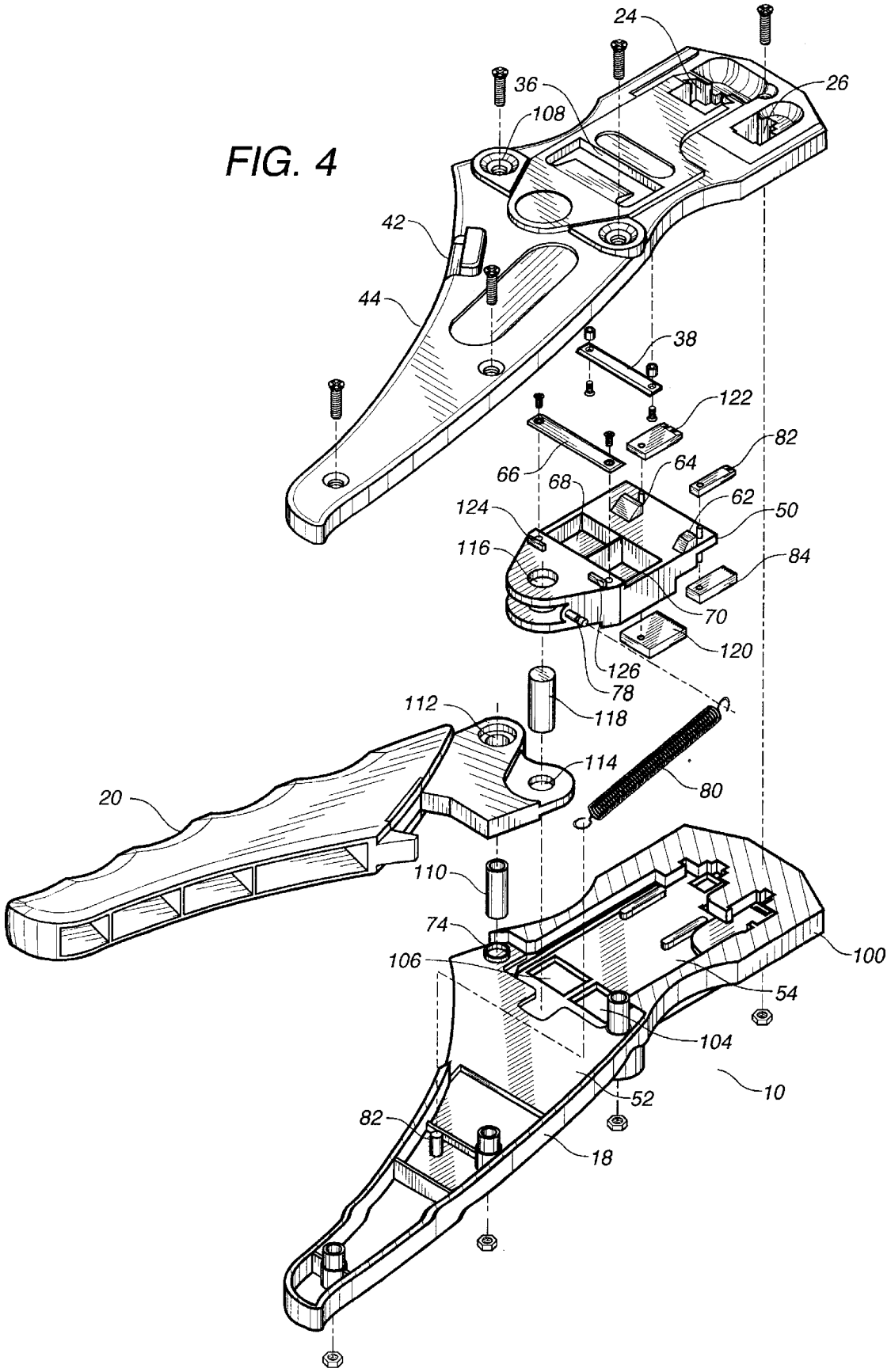
FIG. 4 is an exploded view of the apparatus of the present invention.

FIG. 4 shows an exploded view of the apparatus 10 of the present invention. The apparatus 10 includes the fixed handle 18 and the movable handle 20. It can be seen that the fixed handle 18 has a first side portion 100 and a second side portion 102. The first side portion 100 is connected to the second side portion 102 through the use of various nut-and-bolt connections. As can be seen, the first side portion 100 includes a slide cavity 54 which is connected to the internal cavity 52 of the fixed handle 18. The internal cavity 54 will serve to slidably receive the sliding body 50 therein. The side portion 100 of the fixed handle 18 also includes openings 104 and 106 formed therein. Openings 104 and 106 allow for the disposal of the stripped sheathing after it has been removed from the electrical line of the telco cord. Post 82 is formed on the side portion 100 for the receipt of an end of the spring 80. The opposite end of the spring 80 will be connected to post 78 on the sliding body 50.

The movable handle 20 is pivotally connected at 74 to the side portion 100 of the fixed handle 18. Similarly, the movable handle 20 is pivotally connected to the opening 108 formed on the other side portion 102 of fixed handle 18. The tubular member 110 will extend through the hole 112 on the movable handle 20 as to facilitate this rotatable connection between the movable handle 20 and the fixed handle 18.

The movable handle 20 also includes a hole 114 suitable for pivotally connecting to the slide body 50 through the opening 116 on the slide body 50. A tubular member 118 is inserted through the hole 114 and the hole 116 so as to establish this pivotal connection.

The slide body 50 includes openings 68 and 70 as the receiving areas for the stripped ends of the telco cord. A stripping blade 66 is connected to the sliding body 50 at the bottom of the receiving area 68 and 70. Shoulders 62 and 64 are formed on the sliding body 50 so as to support the bottom edges of the outer crimping block 84 and the inner crimping block 82. Similarly, the shoulder 64 supports the bottom edge of the other crimping blocks 120 and 122. Shoulders 124 and 126 are formed so as to support the bottom edge of the stripping blade 66.

It can be seen that the stripping opening 36 is formed in the side portion 102 of the fixed handle 18. The cutting blade 42 is also formed on the inner face 44 of the side portion 102. The cutting blade 38 can be affixed adjacent to the upper edge of the stripping opening 36 so as to facilitate the stripping of the sheathing from the electrical lines of the telco cord. The side portion 102 also includes first receptacle 24 and second receptacle 26. When the apparatus 10, as shown in FIG. 4, is properly assembled, then it will function in the manner as desired.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An apparatus for the cutting, stripping and crimping of a plug onto a telco cord comprising:

a fixed handle having an internal cavity;

a movable handle pivotally connected to said fixed handle, said fixed handle having a first receptacle for receiving a common plug and a second receptacle for receiving a plug with an offset latch, said second receptacle having a main opening and a latch opening communicating with said main opening and offset from a center of said main opening, said second receptacle positioned to a side of said first receptacle such that said latch opening is adjacent said first receptacle, said second receptacle having a bottom edge generally aligned with a bottom edge of said first receptacle, said second receptacle having a width suitable for receiving a 6-pin plug, said first receptacle having a width suitable for receiving a 10-pin plug therein, said first receptacle having a latch opening positioned centrally along said width;

a sliding body pivotally connected to said movable handle and resiliently connected to said fixed handle, said sliding body having a first crimping block and a second crimping block thereon, said sliding body slidable in said internal cavity between a non-crimping position and a crimping position relative to pivotal movement between said fixed handle and said movable handle, said fixed handle having a stripping opening formed therein, said main body having a stripping blade affixed thereto, said fixed handle having a stripping blade affixed thereto, said stripping blade of said sliding body movable toward said stripping block of said fixed handle relative to an angular movement between said fixed handle and said movable handle, said stripping opening having a first receiving area and a second receiving area, said first receiving area for receiving a 6-line telco cord, said second receiving area for receiving a 10-line telco cord, said fixed handle having a cutting blade affixed thereto along a surface of said fixed handle facing said movable handle, said movable handle having a flat surface formed thereon such that said flat surface contacts an edge of said cutting blade when said movable handle pivots toward said fixed handle, said flat surface being transverse to a plane of said cutting blade, said first crimping block comprising:

an inner crimping block affixed to a top of said sliding body on one side of said sliding body; and an outer crimping block affixed to a top of said sliding body on an opposite side of said sliding body, said sliding body having a first shoulder formed thereon abutting a bottom of said inner crimping block, said sliding body having a second shoulder formed thereon abutting a bottom of said outer crimping block; and a spring having one end connected to said sliding body and an opposite end connected to said fixed handle, said spring having a resilience such that said stripping blades cut through a sheathing of the telco cord without cutting through an electrical line of said telco cord.

* * * * *